US009322583B2

(12) United States Patent
Tadano

(10) Patent No.: US 9,322,583 B2
(45) Date of Patent: Apr. 26, 2016

(54) OIL SEPARATOR AND REFRIGERATION CYCLE APPARATUS

(71) Applicant: PANASONIC CORPORATION, Osaka (JP)

(72) Inventor: Rikio Tadano, Gunma (JP)

(73) Assignee: Panasonic Healthcare Holdings Co., Ltd., Tokyo (JP)

( * ) Notice: Subject to any disclaimer, the term of this patent is extended or adjusted under 35 U.S.C. 154(b) by 172 days.

(21) Appl. No.: 13/951,397

(22) Filed: Jul. 25, 2013

(65) Prior Publication Data

US 2014/0026609 A1 Jan. 30, 2014

(30) Foreign Application Priority Data

Jul. 26, 2012 (JP) ..... 2012-166182

(51) Int. Cl.
*F16T 1/20* (2006.01)
*F25B 43/02* (2006.01)

(52) U.S. Cl.
CPC ..... *F25B 43/02* (2013.01); *F25B 2700/03* (2013.01)

(58) Field of Classification Search
CPC ..... F25B 2700/03; F25B 43/02; F16K 31/28; F16K 33/00; F16K 31/18
USPC ..... 62/84, 468–470; 137/192
See application file for complete search history.

(56) References Cited

U.S. PATENT DOCUMENTS 2,346,069 A * 4/1944 Foresman ..... 137/561 R
2,440,987 A * 5/1948 Thompson ..... 200/84 C
2,510,049 A * 5/1950 Neeson ..... 55/333
3,199,526 A * 8/1965 Pall ..... 137/192
3,621,670 A * 11/1971 Kinney ..... 62/192
4,310,338 A * 1/1982 Schumacher et al. ..... 62/470
4,327,764 A * 5/1982 Biederman ..... F16K 31/22 137/192
4,428,208 A * 1/1984 Krause ..... 62/192
5,076,071 A * 12/1991 Morse ..... 62/503
5,685,331 A * 11/1997 Westermeyer ..... 137/426

FOREIGN PATENT DOCUMENTS

EP 0963771 A1 12/1999
GB 303425 * 1/1929
JP 09-072635 A 3/1997
JP 2002-156274 A 5/2002
JP 2006-000869 A 1/2006
WO WO 2007135443 A1 * 11/2007

OTHER PUBLICATIONS

Japanese Office Action issued in Japanese Patent Application No. 2012-166182, dated Jan. 5, 2016.

* cited by examiner

*Primary Examiner* — Allen Flanigan
*Assistant Examiner* — Filip Zec
(74) *Attorney, Agent, or Firm* — McDermott Will & Emery LLP

(57) ABSTRACT

The oil separator 11 separates oil in the refrigerant discharged from the compressor 4 and returns the oil back to the compressor 4. And includes a tank 21 into which refrigerant discharged from the compressor 4 flows, a float 24 whose inside is hollow formed by welding a plurality of members and made vertically movable according to the changes in the oil surface 20 inside the tank 21, and a needle valve 29 that returns oil inside the tank 21 to the compressor 4 according to the vertical movement of the float 24. The float 24 is provided such that the end point 24E of the welded portion comes above the oil surface 20.

20 Claims, 6 Drawing Sheets

OIL SEPARATOR AND REFRIGERATION CYCLE APPARATUS

CROSS-REFERENCE TO RELATED APPLICATIONS

This application claims the benefit of priority to Japanese Patent Application No. 2012-166182, filed Jul. 26, 2012, of which full contents are incorporated herein by reference.

BACKGROUND OF THE INVENTION

1. Field of the Invention

The present disclosure relates to an oil separator for returning oil in a refrigerant discharged from a compressor back to the compressor and a refrigeration cycle apparatus using the oil separator, in a refrigeration cycle of, for example, an ultracold freezer and the like.

2. Description of the Related Art

An ultracold freezer such as that used in, for example, research facilities and the like includes a refrigeration cycle configured to have a refrigerant circuit with a compressor, a condenser (radiator), a pressure reducer, an evaporator and the like sequentially and circularly connected. Although the refrigeration cycle has filled therein together with the refrigerant a predetermined amount of oil for lubricating the sliding portion of the compressor, some of the oil would be discharged from the compressor together with the refrigerant into the refrigeration cycle.

When oil is discharged into the refrigeration cycle, this becomes the cause of inhibiting the circulation of the refrigerant in the pressure reducer and the evaporator, and exhausts the oil in the compressor to cause burning and the like. Therefore, an oil separator is interposed between the compressor and the condenser.

The oil separator is configured of a tank with a predetermined capacity, and refrigerant (including oil) discharged from the compressor flows into this tank. Means such as a filter is used to separate in the tank the oil contained in the refrigerant and allows only the refrigerant to flow out from the tank toward the condenser. And the tank stores therein oil.

A float is provided in the tank and the float moves up and down according to changes in the oil level in the tank. When the amount of oil in the tank increases and the float rises to a predetermined location in accordance with the increase in the oil level, the valve device opens to return the oil in the tank back to the suction side. Thereby, the oil discharged into the refrigeration cycle is returned to the compressor to solve the aforementioned problem (for example, see Japanese Patent Application Laid-open Publication No. 9-72635 Specification).

By the way, the pressure of the refrigerant discharged from the compressor is of an extremely high value such as 3 MPa when the compressor is operating. In contrast, the pressure drops to about 0.5 MPa when the compressor stops. Thus the pressure in the oil separator would change frequently between the high and low pressures so that the float may be damaged due to such pressure changes. If oil should enter from the damaged portion into the float, the float would lose buoyancy and would be inhibited from detecting the up-down movement of the oil level leading to the oil returning function being lost.

The present disclosure has been made in view of such background and it is therefore an object of the present disclosure to provide an oil separator that can reduce the risk of the oil entering into the float and a refrigeration cycle apparatus using the oil separator.

SUMMARY OF THE INVENTION

An oil separator according to an aspect of the present disclosure, includes an oil separator for separating an oil in a refrigerant discharged from a compressor and returning the oil to the compressor, including:

a tank configured to have the refrigerant discharged from the compressor flow therein;

a hollow float formed by welding a plurality of members and configured to be vertically movable according to a change of an oil level inside the tank; and a valve device configured to return the oil inside the tank to the compressor according to the vertical movement of the float, the float being provided to have an end point of a welded portion to come above the oil surface.

Other features of the present disclosure will become apparent from the descriptions of this specification and the accompanying drawings.

BRIEF DESCRIPTION OF THE DRAWINGS

For a more thorough understanding of the present disclosure and advantages thereof, the following description should be read in conjunction with the accompanying drawings, in which.

DETAILED DESCRIPTION OF THE INVENTION

At least the following details will become apparent from the description of this specification and of the accompanying drawings.

==Ultracold Freezer 1==

Figure 1:
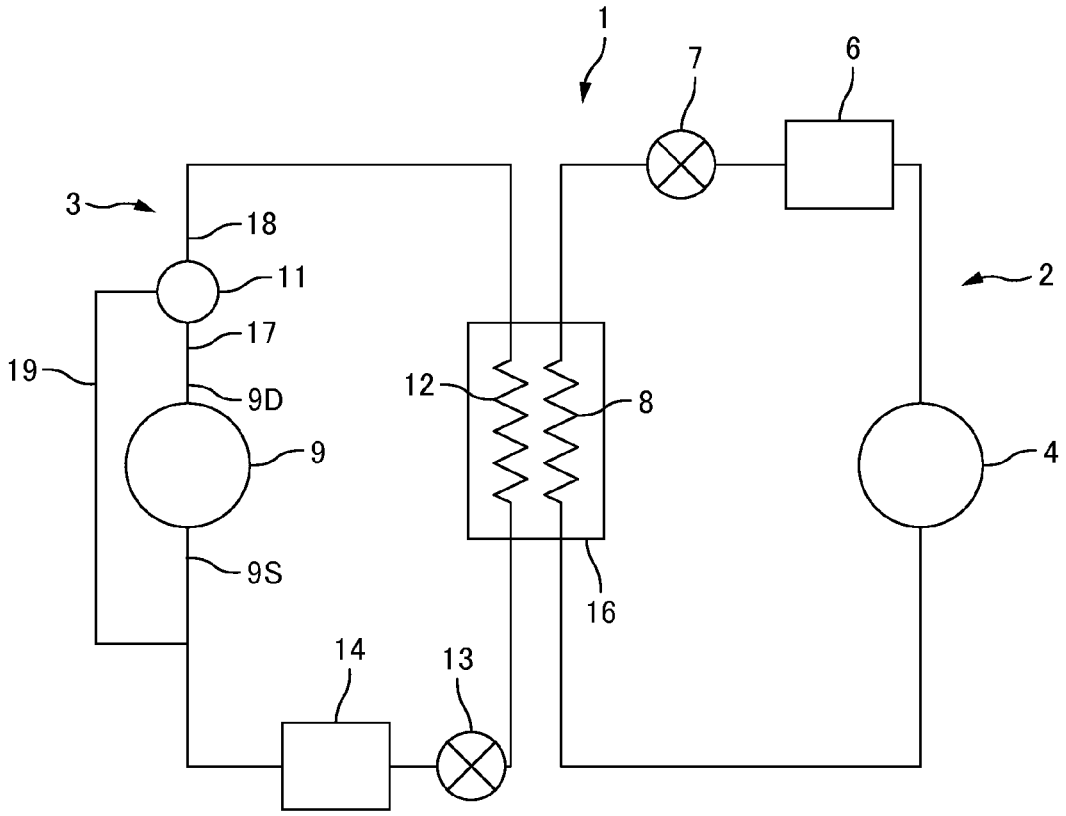
FIG. 1 is a view of a refrigeration circuit of an ultracold freezer according to a first embodiment of the present disclosure.

In the following description, an embodiment of the present disclosure will be described in detail with reference to the drawings. The refrigeration circuit shown in FIG. 1 is for cooling, to an ultralow temperature of minus 80 degrees to minus 150 degrees Celsius, the inside (not shown) of the ultracold freezer 1 which is an embodiment of the freezer cycle apparatus of the present disclosure, and the refrigeration circuit includes a high temperature side refrigeration circuit 2 and a low temperature side refrigeration circuit 3 cascade connected to this high temperature side refrigeration circuit 2.

The high temperature side refrigeration circuit 2 is configured with a compressor 4, a condenser 6 as a radiator, a capillary tube (or expansion valve) 7 as a pressure reducer, and an evaporator 8 that are sequentially and circularly connected. The low temperature side refrigeration circuit 3 is configured with the pipes of a compressor 9, an oil separator 11 of the present disclosure, a condenser 12 as a radiator, a capillary tube (or an expansion valve) 13 as a pressure reducer, and an evaporator 14 that are sequentially and circularly connected. And the condenser 12 of the low temperature side refrigeration circuit 3 and the evaporator 8 of the high temperature side refrigeration circuit 2 are arranged in a heat exchange relation to configure a cascade heat exchanger 16.

The oil separator 11 plays a role for separating oil in the refrigerant discharged from the compressor 9 of the low temperature side refrigeration circuit 3 and returning the oil back to the compressor 9. The discharge pipe 9D of the compressor 9 of the low temperature side refrigeration circuit 3 is connected to the refrigerant inlet pipe 17 of the oil separator 11, and the refrigerant outlet pipe 18 of the oil separator 11 is connected to the condenser 12. The oil return pipe 19 of the oil separator 11 is connected to the suction pipe 9S of the compressor 9.

During operation of the compressor 4 of the high temperature side refrigeration circuit 2, the high temperature and pressure gas refrigerant discharged from the compressor 4 flows into the condenser 6 and heat is dissipated therein to be condensed and liquefied. The refrigerant condensed in the condenser 6 is restricted by the capillary tube 7 and thereafter flows into the evaporator 8 to be evaporated to exert an endothermic effect. The cycle of the refrigerant evaporated in the evaporator 8 being drawn into the compressor 4 again is repeated.

During operation of the compressor 9 of the low temperature side refrigeration circuit 3, the high temperature and pressure gas refrigerant discharged from the discharge pipe 9D of the compressor 9 flows from the refrigerant inlet pipe 17 into the oil separator 11. The refrigerant gas having oil separated by the oil separator 11 flows out from the refrigerant outlet pipe 18 and into the condenser 12. The oil separated by the oil separator 11 is returned through the oil return pipe 19 back to the suction pipe 9S of the compressor 9, as to be described later.

The low temperature side refrigeration circuit 3 has refrigerant of an extremely low boiling point filled therein for achieving the ultralow temperature described above. Since the condenser 12 is cooled at the cascade condenser 16 by the endothermic action of the evaporator 8 in the high temperature side refrigeration circuit 2, the refrigerant is smoothly condensed and liquefied. The refrigerant condensed in the condenser 12 is restricted by the capillary tube 13 and thereafter flows into the evaporator 14 to evaporate. The endothermic effect at this time is exerted to cool the interior of the refrigerator, not shown. The compressor 9 is turned ON and OFF based on the temperature inside the refrigerator, and the interior of the refrigerator is cooled to a preset temperature of an ultracold temperature within the range between minus 80 degrees to minus 150 degrees Celsius mentioned above.

The refrigerant evaporated in the evaporator 14 repeats the cycle of being drawn into the compressor 9 by the suction pipe 9S again. The oil returning through the oil return pipe 19 goes back to the compressor 9 through the suction pipe 9S together with the refrigerant from the evaporator 14.

==Oil Separator 11==

Figure 2:
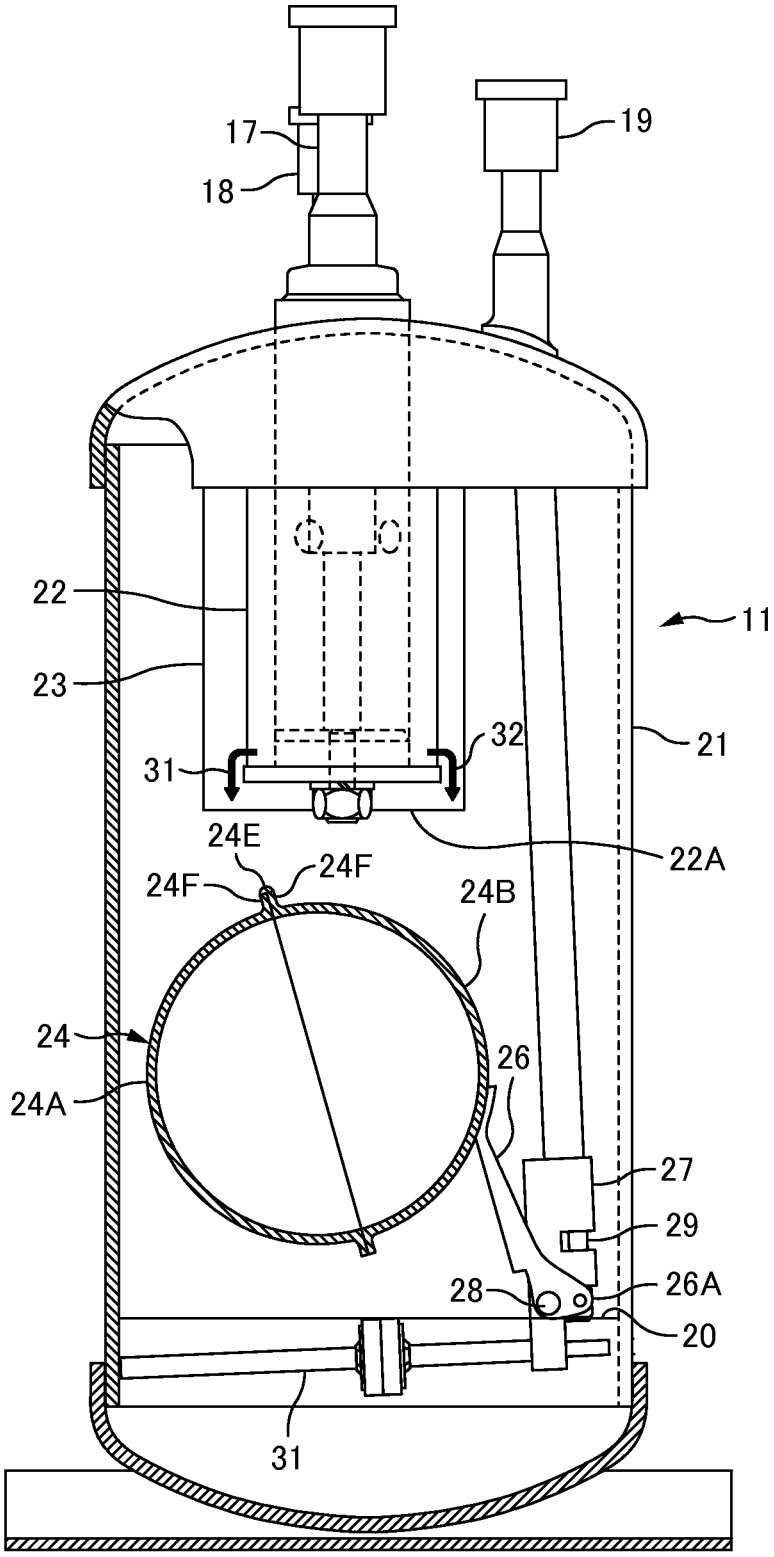
FIG. 2 is a vertical sectional view of the oil separator according to the first embodiment of the present disclosure.
Figure 3:
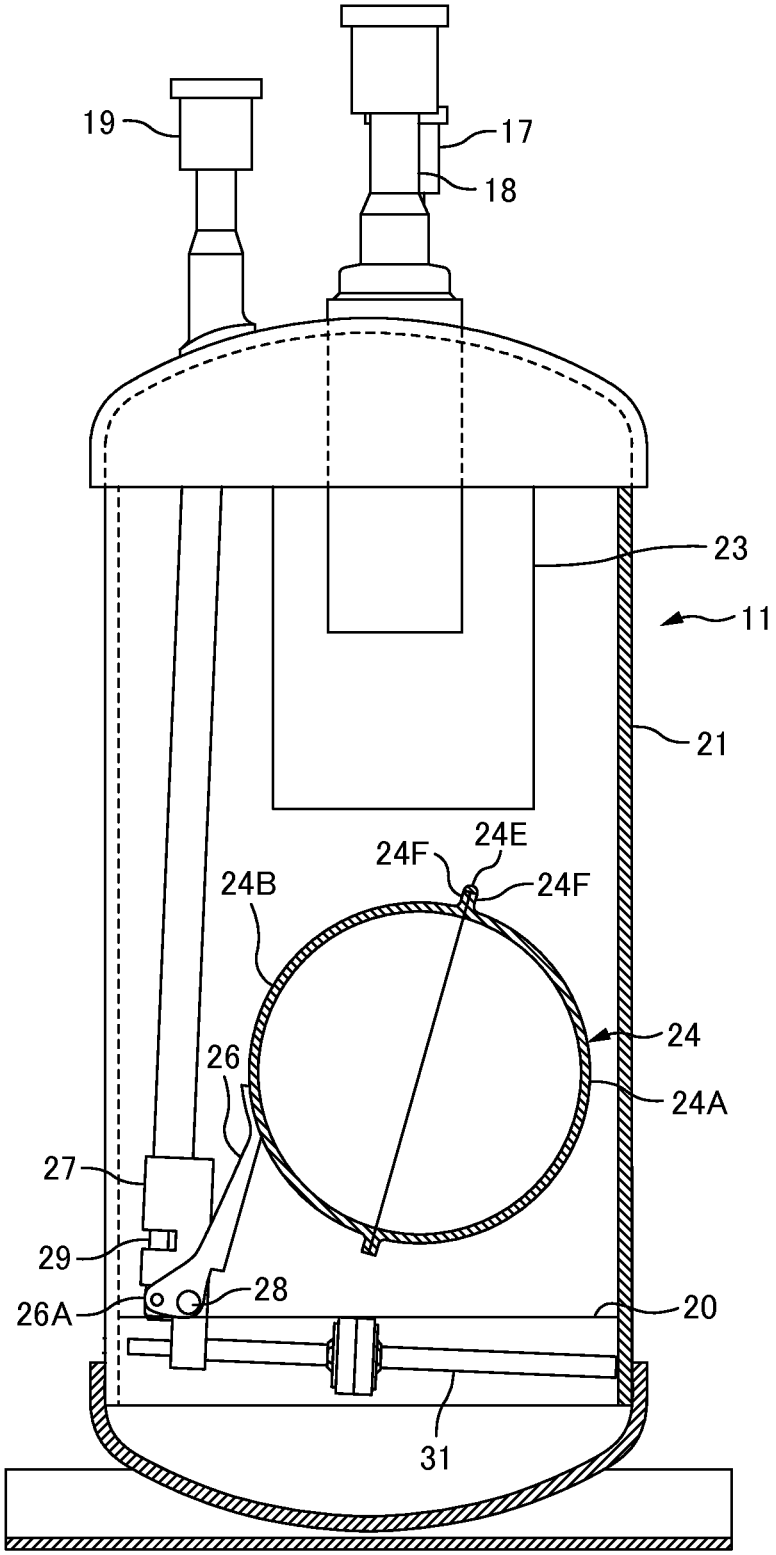
FIG. 3 is another vertical sectional view of the oil separator according to the first embodiment of the present disclosure.

Next, description of an embodiment of the oil separator 11 according to the present disclosure will be given with reference to FIGS. 2 to 4. The tank 21 of a predetermined capacity is of a vertical long cylindrical shape having its top and bottom sealed to withstand high pressure. A refrigerant inlet pipe 17 and a refrigerant outlet pipe 18 are inserted into the tank 21 from above with their mouths open at the upper portion within the tank 21. The oil return pipe 19 is also inserted into the tank 21 from above and has its mouth open at the bottom portion within the tank 21.

A filter 22 is attached around the opening of the refrigerant inlet pipe 17 within the tank 21. The oil within the refrigerant that has flowed from the refrigerant inlet pipe 17 as described above, is separated by this filter 22. Note that a centrifuge may be provided in place of the filter 22. In other words, a mechanism that separates the oil in the refrigerant should be provided. The oil separated by the filter 22 falls downward from the sides of the receiving plate 22A as shown with arrows 31 and 32, and is collected at the bottom portion within the tank 21. The refrigerant gas having oil separated by the filter 22 flows through the inside of the tank 21 into the refrigerant outlet pipe 18 and out from the oil separator 11 to the condenser 12. In this way, oil is prevented from flowing out in the low temperature side refrigeration circuit 3 at the oil separator 11 and those subsequent thereto, and disadvantages such as poor refrigerant circulation due to solidification of the oil in the evaporator 14 and the like that becomes ultra cold as described above, are avoided. The interior of the tank 21 between the refrigerant inlet pipe 17 and the refrigerant outlet pipe 18 is divided with a divider plate 23 so that a so-called short circuit of the refrigerant gas is prevented.

A hollow float 24 is contained at a lower portion in the tank 21. This float 24 plays a role in floating on the oil surface 20 of the oil separated by the filter 22 and collected at the bottom portion in the tank 21, and allows detection of the oil level. The float 24 is held to the oil return pipe 19 via the float lever 26 and the mounting hardware 27 in a vertically movable manner.

The mounting hardware 27 is attached to the lower end of the oil return pipe 19. One end of the float lever 26 is pivotally supported to the mounting hardware 27 in a vertically rotatable manner with the horizontal rotation axis 28 at the center. The other end of the float lever 26 is welded and fixed to the side face of the float 24 and hereby the float 24 is held in a vertically movable manner in the tank 21 under the filter 22 and the like. One end of the float lever 26 extends from the rotation axis 28 further towards a direction opposite the float 24, and the bottom end of the needle valve 29 (valve device) is attached to the extended portion 26A in a rotatable manner. The top end of the needle valve 29 corresponds to the bottom end opening of the oil return pipe 19, and the top end of the needle valve 29 closes the bottom end opening of the oil return pipe 19 when at a raised state and opens the bottom end opening at a descended state. The retaining hardware 31 maintains the positions of the oil return pipe 19 and the float 24 in the tank 21.

The oil separated from the refrigerant gas by the filter 22 falls from the filter 22 to be collected at the bottom portion in the tank 21, as described above. The float 24 floats on this stored oil surface 20. When the oil surface 20 (oil level) rises with the increase in the amount of oil, the float 24 rises therewith. When the float 24 is raised, the float lever 26 rotates in the clockwise direction in FIG. 2, with the rotation axis 28 as the center to reach the state shown in FIG. 4. Since the extended portion 26A rotates in the clockwise direction along with the above rotation, the needle valve 29 is lowered to open the lower end opening of the oil return pipe 19 (FIG. 4). Since the interior of the tank 21 is under high pressure during the operation of the compressor 9, when the lower end opening of the oil return pipe 19 is opened, the oil stored in the tank 21 flows into the lower end opening of the oil return pipe 19 and flows through this oil return pipe 19 to return to the compressor 9 as described above. And hereby, burning due to the exhaustion of oil in the compressor 9 is prevented.

When the oil flows out so that the amount of oil inside the tank 21 is reduced, the oil surface 20 (oil level) is lowered and the float 24 is lowered therewith. With the lowering of the float 24, the float lever 26 rotates in the anti-clockwise direction in FIG. 2 with the rotation axis 28 as the center. Since the extended portion 26A rotates in the anti-clockwise direction along with the above rotation, the needle valve 29 is pushed up to close the lower end opening of the oil return pipe 19 (FIGS. 2 and 3). Hereby, the amount of oil in the tank 21 of the oil separator 11 is adjusted to be kept from reaching a predetermined value at all times.

==Float 24==

Next, description of the float 24 in the oil separator according to the present disclosure will be given. The floats 24 according to the present embodiment are all hollow spherical bodies configured by welding and fixing together halved hemispherical (hollow) stainless steel first and second float members 24A and 24B along the entire circumference of flanges 24F provided around the opening. The float 24 of the present embodiment is made of stainless steel and the volume thereof is regarded to be 137.3 (cc (mL)), weight 71.4 (grams), surface area 128.7 (square centimeters), and maximum buoyancy approximately 52.1 (grams). And the margin of buoyancy obtained from the balancing of the float lever 26 is regarded to be approximately 17.9 (grams). Note that, the float 24 may be made of metal such as iron.

The float 24 has the endpoint 24E, of the welded portion (bead) formed along the flange 24F, provided so to be always above the oil surface 20. In other words, the end point 24E of the welded portion is provided so to be always above the oil surface 20, even when the float 24 is in a raised state with the rising of the oil surface 20 as shown in FIG. 4, and even when the float 24 is in a lowered state with the lowering of the oil surface 20 as shown in FIGS. 2 and 3.

Further, the float 24 also has the endpoint 24E provided to come at the uppermost position at the time the oil surface 20 is at the uppermost position (FIG. 4) which is when the lower end opening of the oil return pipe 19 open. In other words, the float 24 is welded to the float lever 26 so that the end point 24E is positioned at the uppermost portion of the float 24 in the state shown in FIG. 4. Hereby, the position of the end point 24E can be positioned as high as possible with regard to the oil surface 20 (and the float 24) at all times.

Further, the float 24 is slanted so that the end point 24E is not positioned vertically under the end portion of the receiving plate 22A of the filter 22.

As described above, since a gas refrigerant of high temperature and pressure discharged from the compressor 9 flows into the oil separator 11, the pressure inside the tank 21 rises to approximately 3 MPa with the embodiments of the compressor 9 under operation. Further, the pressure inside the tank 21 falls to approximately 0.5 MPa when the compressor 9 stops. Damages (cracks) may occur to the float 24 by metal fatigues and the like due to large pressure changes as above. Particularly, matters formed by welding are likely to crack (end splitting) at the end of the welded portion.

According to the oil separator 11 of the present embodiment, the risk of the oil inside the tank 21 entering into the float 24 can be reduced since the float 24 is provided so that the end point 24E of the welded portion where cracks are likely to occur is positioned above the oil surface 20. In this way, the state of the float 24 losing buoyancy can be prevented. Therefore, deficiencies of the needle valve 29 remaining closed so to prevent oil from returning to the compressor 9 can be avoided.

Further, since the oil separator 11 of the present embodiment has the float 24 created by welding and fixing the flanges 24F of the first and the second float members 24A, 24B, the float 24 has the endpoint 24E of the welded portion provided so that cracks are likely to occur to this endpoint 24E portion rather than the other portions. Therefore, a crack would occur at the end point 24E before any other portion and conversely, it is expected that a crack would not occur at the other portions since stress would be released due to a crack occurring at the end point 24E. Hereby, even when a crack should occur to the float 24, the crack can be made to be generated at the endpoint 24E that is always positioned above the oil surface 20. Therefore, the risk of oil entering into the float 24 can be further reduced.

Figure 4:
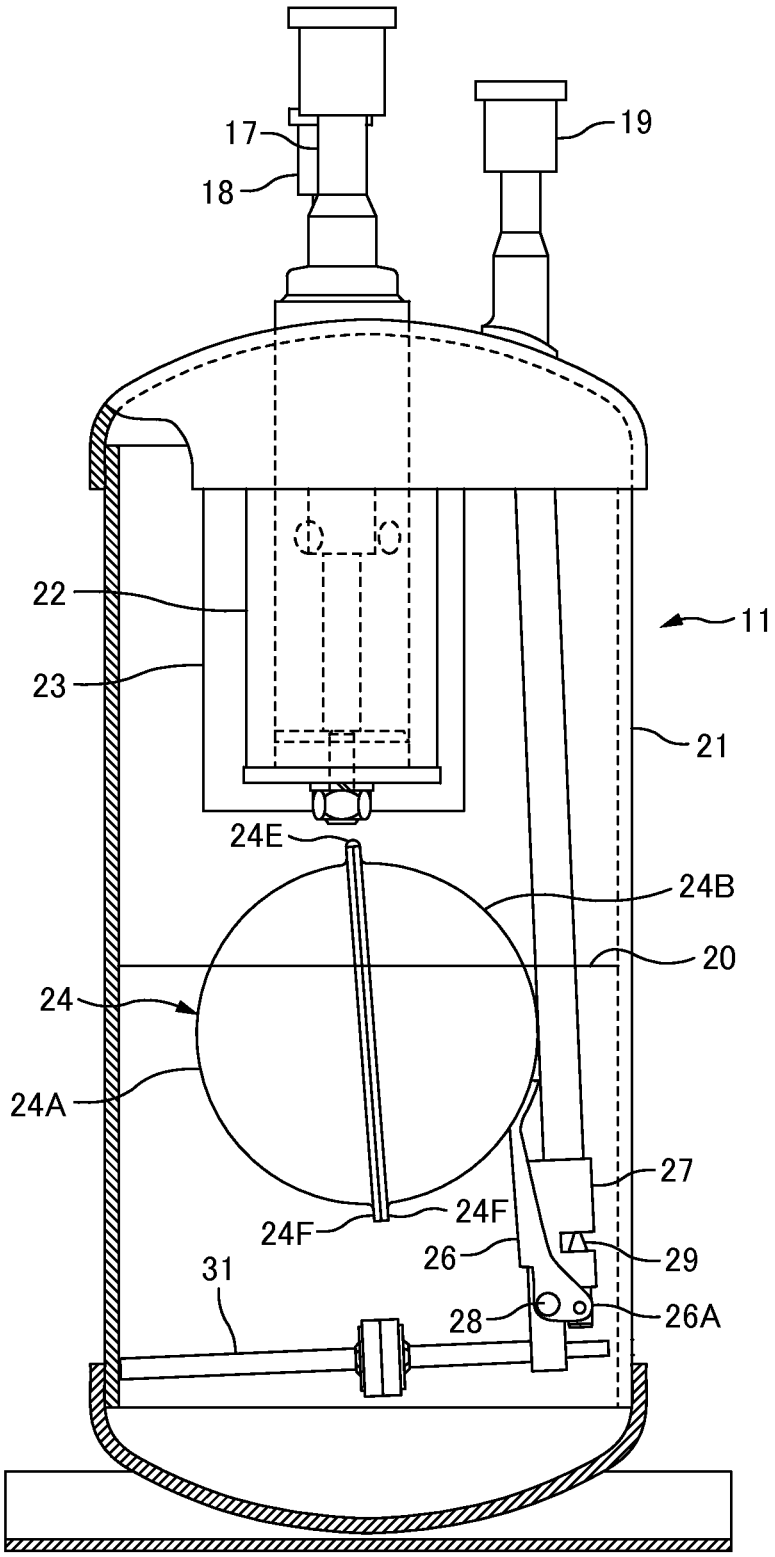
FIG. 4 is a diagram showing the float of the oil separator of FIG. 2 in a raised state.

Further, as shown in FIG. 4, the oil separator 11 of the present embodiment has the float 24 provided so that the end point 24E of the welded portion comes to the uppermost position when the lower end opening of the oil return pipe 19 is open, that is, when the oil surface 20 is at the uppermost location. Because the float 24 rotates with the rotation axis 28 as the center, the endpoint 24E of the welded portion comes to a lower position as the oil surface 20 lowers (in other words, as the amount of oil inside the tank 21 decreases), and the end point 24E of the welded portion comes to a higher position as the oil surface 20 rises (in other words, as the amount of oil inside the tank 21 increases). Therefore, the end point 24E of the welded portion that is likely to crack can be maintained at a state most distant from the oil surface 20. Thus, the risk of oil entering into the float 24 can be further reduced even when a crack should be generated at the end point 24E.

Furthermore, the oil separator 11 of the present embodiment has the float 24 inclined so that the end point 24E is not positioned vertically under the end portion of the receiving plate 22A of the filter 22. In other words, oil from the filter 22 is kept from falling directly on the end point 24E. Therefore, oil falling from the filter 22 is kept from entering through the crack and into the float 24 even when a crack is generated at the end point 24E.

==Modified Example of Divider Plate 23==

Figure 5:
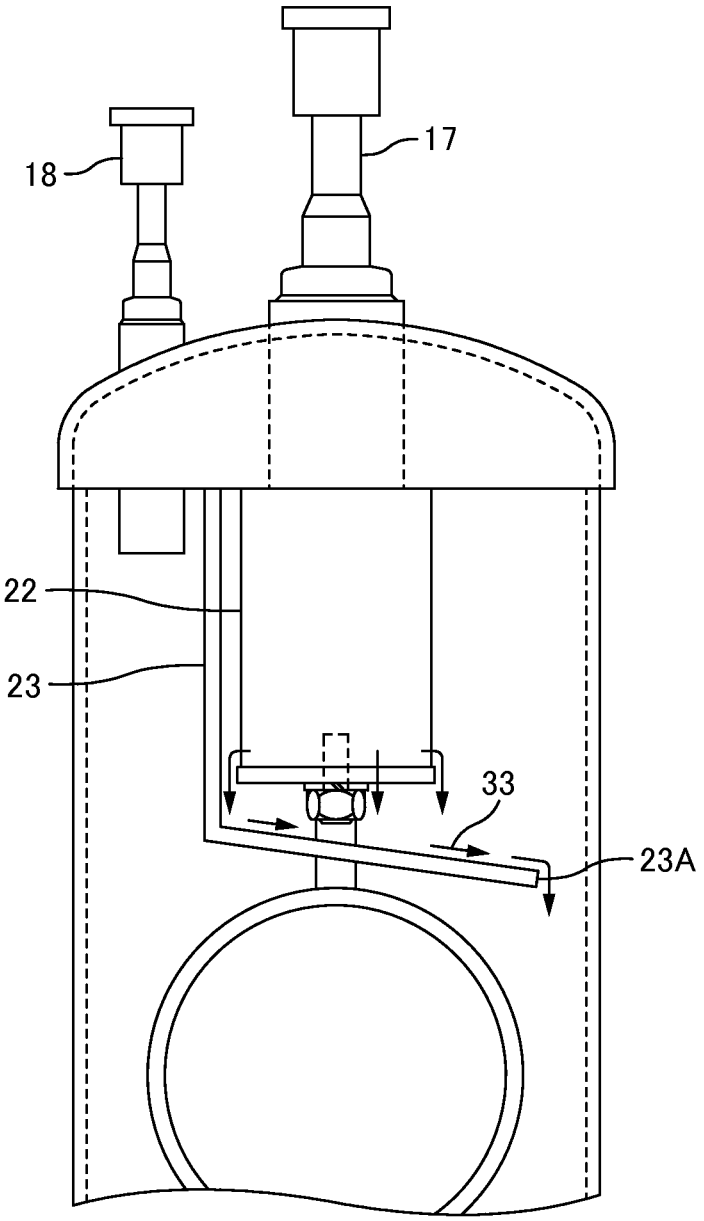
FIG. 5 is a diagram showing a modified example with the divider bent.

FIG. 5 shows a modified example having the divider plate 23 bended. The bended divider plate 23 receives oil that falls from the filter 22 and guides the oil towards the face of the wall of the tank 21. The divider plate 23 in FIG. 5 is extended to cover the whole top portion of the float 24. The oil that has fallen from the filter 22 is guided along the top of the divider plate 23 as shown with arrow 33 and thereafter falls vertically downward at the free end 23A. The divider plate 23 is placed so that the float 24 is not positioned under the free end 23A. Hereby, the oil guided by the bended divider plate 23 falls to the bottom portion in the tank 21 without touching the float 24. Therefore, oil can be prevented from entering through the crack portion and into the float 24 even when a crack is generated to the float 24.

Note that, the divider plate 23 may be of a length that does not cover the entire float 24 as long as the upper portion of the endpoint 24E of the welded portion is covered. In other words, the length of the divider plate 23 can be of any length as long as the oil from the free end 23A of the bended divider plate 23 does not fall directly on the end point 24E regardless of the position where the float 24 is vertically moved. Oil can be prevented from entering into the float 24 even when a crack is generated to the end point 24E as long as oil is kept from falling directly on the upper portion of the endpoint 24E, since a crack is expected to be generated to the endpoint 24E portion before the other portions of the float.

Still further, the divider plate 23 may be curved. Still furthermore, the divider plate 23 may be inclined and extended so to cover the upper portion of the float 24 (or the end point 24E) from between the refrigerant inlet pipe 17 and the refrigerant outlet pipe 18.

==Guide Plate 25==

Figure 6:
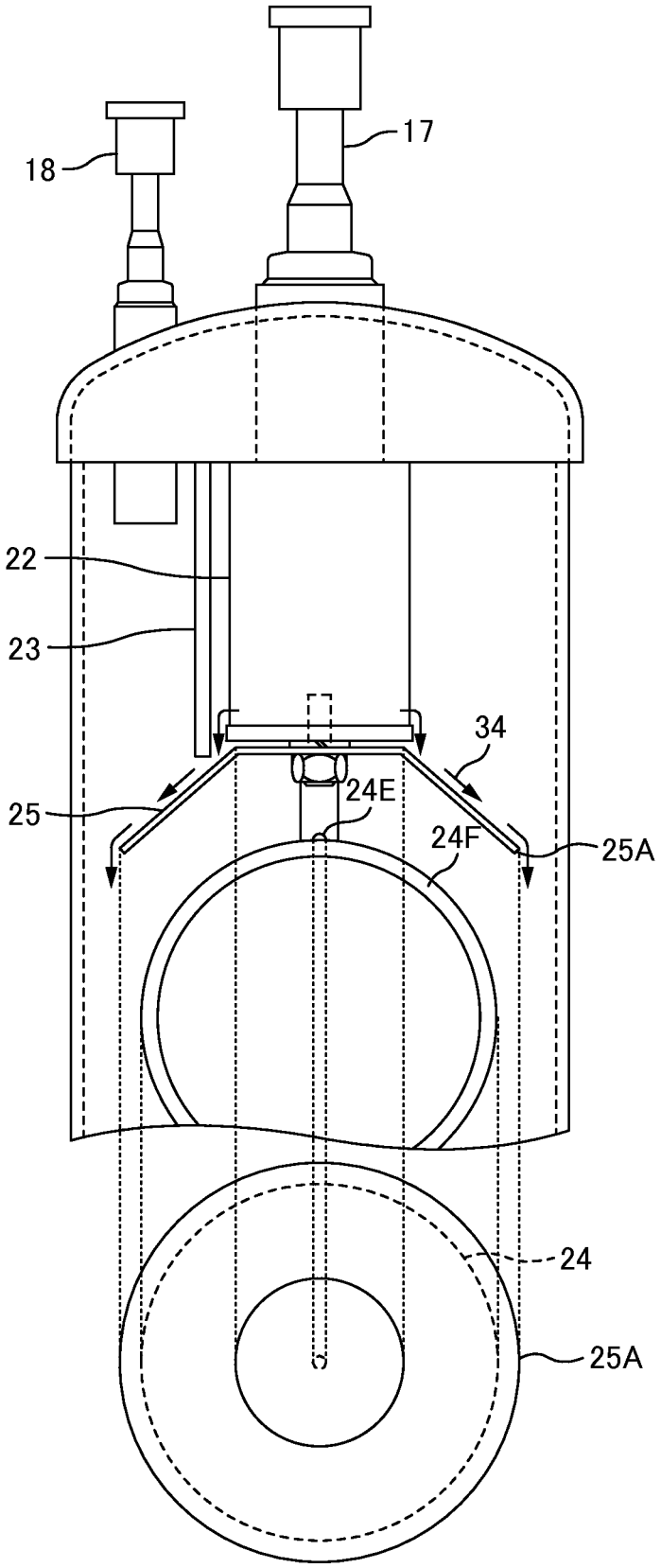
FIG. 6 is a diagram showing a modified example that has provided above the float a guide plate that receives oil that falls from the filter.

FIG. 6 illustrates a modified example where a guide plate 25 that receives the oil falling from the filter 22 is provided above the float 24. The guide plate 25 receives the oil that falls form the filter 22 and guides the oil towards the face of the wall. The guide plate 25 in FIG. 6 is extended to cover the entire top portion of the float 24. The oil that has fallen from the filter 22 is guided along the top of the guide plate 25 as shown with arrow 34 and thereafter falls vertically downward at the end 25A. The guide plate 25 is of a size such that the float 24 is not positioned under the end 25A. In this way, the oil guided by the guide plate 25 falls to the bottom portion in the tank 21 without touching the float 24. Therefore, oil is prevented from entering through the crack portion and into the float 24 even when a crack is generated at the end point 24E of the welded portion.

Note that, although FIG. 6 assumes the guided plate 25 to be practically circular, the shape is not limited to such and can be for example, rectangular. Further, the guide plate 25 may be of a size that does not cover the entire float 24 as long as the end point 24E of the welded portion is covered from above. In other words, the guide plate 25 can be of any size and shape that prevents oil from the end 25A of the guide plate 25 from falling directly on the end point 24E regardless of the position where the float 24 is vertically moved. Oil can be prevented from entering into the float 24 even when a crack is generated to the end point 24E as long as oil is kept from falling directly on the upper portion of the end point 24E, since a crack is expected to be generated to the end point 24E portion before the other portions of the float.

Note that in the present embodiment, description has been given of the present disclosure with the oil separator 11 that mechanically controls the returning to the oil with the vertical movement of the float 24 using the float lever 26 and the needle valve 29. However, the oil separator 11 is not limited to such and as in the aforementioned Japanese Patent Application No. 9-72635 Publication, the present disclosure is effective also for an oil separator that opens and closes the contact point with the vertical movement of the float 24 and opens and closes the solenoid valve (valve device) provided to the oil return pipe 19.

As described above, the oil separator 11 of the present embodiment is for separating oil in the refrigerant discharged from the compressor 9 and returning the oil back to the compressor 9, and includes a tank 21 into which refrigerant discharged from the compressor 9 flows, afloat 24 whose inside is hollow formed by welding a plurality of members and made vertically movable according to the changes in the oil surface 20 inside the tank 21, and a needle valve 29 (valve device) that returns the oil inside the tank 21 back to the compressor 9 according to the vertical movement of the float 24, wherein the float 24 is provided such that the endpoint 24E of the welded portion comes above the oil surface 20. Therefore, the possibility of oil entering into the float can be reduced even when a crack is generated since the end point 24E of the welded portion where cracks are likely to be generated, comes above the oil surface 20.

Furthermore, in the oil separator 11 of the present embodiment, the float 24 is provided such that the end point 24E of the welded portion is positioned at the uppermost portion of the float 24 when the oil surface 20 changes to reach the highest position. Therefore, the end point 24E can be positioned to a location farthest from the oil surface 20 so that the possibility of oil entering into the float can be further restrained.

Further, the oil separator 11 of the present embodiment includes a filter 22 (separating mechanism) that separates oil in the refrigerant, and the float 24 is provided in such a manner that oil does not fall from the filter 22 and on the end point 24E of the welded portion. Hereby, the possibility of oil entering into the float 24 can be further restrained.

Further, in the oil separator 11 of the present embodiment, the divider plate 23 provided between the refrigerant inlet pipe 17 and the refrigerant outlet pipe 18, may be curved, bent or inclined and extended to receive and guide the oil so that the oil is kept from falling on the end point 24E of the welded portion. And in this case, the risk of oil guided by the divider plate 23 entering through a crack and into the float 24 can be further reduced even when a crack should be generated at the end point 24E.

Further, the oil separator 11 of the present embodiment can further include a guide plate 25 that receives and guides the oil so that the oil is kept from falling on the end point 24E of the welded portion. And also in this case, the risk of oil guided by the guide plate 25 entering through a crack and into the float 24 can be further reduced even when a crack is generated at the end point 24E.

Further, in the ultracold freezer 1 of the present embodiment, a low temperature side refrigeration circuit 3 is configured by circular connection of the compressor 9, a condenser 12 as a radiator, a capillary tube (or an expansion valve) 13 as a pressure reducer, and an evaporator 14, and further the aforementioned oil separator 11 is connected between the compressor 9 and the condenser 12. Therefore, in the ultracold freezer 1 of the present embodiment, the state of the float 24 losing buoyancy is avoided since the risk of oil entering into the float 24 is reduced as described above, and the deficiency of the needle valve 29 remaining closed so that the oil is prevented from returning to the compressor 9 can be avoided.

The above embodiments of the present disclosure are simply for facilitating the understanding of the present disclosure and are not in any way to be construed as limiting the present disclosure. The present disclosure may variously be changed or altered without departing from its spirit and encompass equivalents thereof.

What is claimed is:

1. An oil separator for separating oil in a refrigerant discharged from a compressor and for returning the oil to the compressor, comprising:

a tank configured to have the refrigerant discharged from the compressor be flown thereinto;

a float formed by welding a plurality of members and including a welded portion having an end point in the welding, the float being configured to be vertically movable according to a change of an oil level inside the tank, the end point being positioned above an oil surface; and a valve configured to return the oil inside the tank to the compressor according to the vertical movement of the float, wherein the end point comprises a protrusion extending away from a surface of the float.

2. The oil separator according to claim 1, wherein the end point of the welded portion is positioned at substantially an uppermost portion of the float when the valve is opened.

3. The oil separator according to claim 1, further comprising:

a separating mechanism provided above the float and configured to separate the oil in the refrigerant discharged from the compressor, the separating mechanism including a first portion, the oil separated by the separating mechanism is fallen from the first portion, wherein the first portion is not positioned just above the end point to prevent the oil separated by the separating mechanism from falling onto the end point.

4. The oil separator according to claim 1, further comprising:

a divider plate configured to be provided between a refrigerant inlet and a refrigerant outlet, wherein the divider plate is curved, bent or inclined and extended in order to receive and guide the oil in such a manner that the oil is prevented from falling onto the end point of the welded portion.

5. The oil separator according to claim 1, further comprising:

a guide plate configured to receive and guide the oil in such a manner that the oil is prevented from falling onto the end point of the welded portion.

6. A freezer cycle apparatus characterized in that a refrigerant circuit is configured by circularly connecting a compressor, a radiator, a pressure reducer and an evaporator, and the oil separator described in claim 1 is connected between the compressor and the radiator.

7. A freezer cycle apparatus characterized in that a refrigerant circuit is configured by circularly connecting a compressor, a radiator, a pressure reducer and an evaporator, and the oil separator described in claim 2 is connected between the compressor and the radiator.

8. A freezer cycle apparatus characterized in that a refrigerant circuit is configured by circularly connecting a compressor, a radiator, a pressure reducer and an evaporator, and the oil separator described in claim 3 is connected between the compressor and the radiator.

9. A freezer cycle apparatus characterized in that a refrigerant circuit is configured by circularly connecting a compressor, a radiator, a pressure reducer and an evaporator, and the oil separator described in claim 4 is connected between the compressor and the radiator.

10. A freezer cycle apparatus characterized in that a refrigerant circuit is configured by circularly connecting a compressor, a radiator, a pressure reducer and an evaporator, and the oil separator described in claim 5 is connected between the compressor and the radiator.

11. An oil separator for separating oil in a refrigerant discharged from a compressor and for returning the oil to the compressor, comprising:

a tank configured to have the refrigerant discharged from the compressor be flown thereinto;

a float formed by welding a plurality of members and including a welded portion having an end point in the welding, the float being configured to be vertically movable according to a change of an oil level inside the tank, the end point being positioned above an oil surface; and a valve configured to return the oil inside the tank to the compressor according to the vertical movement of the float, wherein the end point is a point where cracks are more likely to occur than the remaining welded portion.

12. The oil separator according to claim 11, wherein the end point of the welded portion is positioned at substantially an uppermost portion of the float when the valve is opened.

13. The oil separator according to claim 11, further comprising:

a separating mechanism provided above the float and configured to separate the oil in the refrigerant discharged from the compressor, the separating mechanism including a first portion, the oil separated by the separating mechanism is fallen from the first portion, wherein the first portion is not positioned just above the end point to prevent the oil separated by the separating mechanism from falling onto the end point.

14. The oil separator according to claim 11, further comprising:

a divider plate configured to be provided between a refrigerant inlet and a refrigerant outlet, wherein the divider plate is curved, bent or inclined and extended in order to receive and guide the oil in such a manner that the oil is prevented from falling onto the end point of the welded portion.

15. The oil separator according to claim 11, further comprising:

a guide plate configured to receive and guide the oil in such a manner that the oil is prevented from falling onto the end point of the welded portion.

16. A freezer cycle apparatus characterized in that a refrigerant circuit is configured by circularly connecting a compressor, a radiator, a pressure reducer and an evaporator, and the oil separator described in claim 11 is connected between the compressor and the radiator.

17. A freezer cycle apparatus characterized in that a refrigerant circuit is configured by circularly connecting a compressor, a radiator, a pressure reducer and an evaporator, and the oil separator described in claim 12 is connected between the compressor and the radiator.

18. A freezer cycle apparatus characterized in that a refrigerant circuit is configured by circularly connecting a compressor, a radiator, a pressure reducer and an evaporator, and the oil separator described in claim 13 is connected between the compressor and the radiator.

19. A freezer cycle apparatus characterized in that a refrigerant circuit is configured by circularly connecting a compressor, a radiator, a pressure reducer and an evaporator, and the oil separator described in claim 14 is connected between the compressor and the radiator.

20. A freezer cycle apparatus characterized in that a refrigerant circuit is configured by circularly connecting a compressor, a radiator, a pressure reducer and an evaporator, and the oil separator described in claim 15 is connected between the compressor and the radiator.

* * * * *